United States Patent [19]

Heynisch

[11] 4,451,759

[45] May 29, 1984

[54] FLAT VIEWING SCREEN WITH SPACERS BETWEEN SUPPORT PLATES AND METHOD OF PRODUCING SAME

[75] Inventor: Hinrich Heynisch, Gräfelfing, Fed. Rep. of Germany

[73] Assignee: Siemens Aktiengesellschaft, Berlin and Munich, Fed. Rep. of Germany

[21] Appl. No.: 306,158

[22] Filed: Sep. 28, 1981

[30] Foreign Application Priority Data

Sep. 29, 1980 [DE] Fed. Rep. of Germany ..... 3036671

[51] Int. Cl.[3] ..... H01J 9/24; H01J 29/86

[52] U.S. Cl. ..... 313/495; 445/22

[58] Field of Search ..... 313/495, 422, 485, 584, 313/585; 445/22, 24

[56] References Cited

U.S. PATENT DOCUMENTS

| | | | |
|---|---|---|---|
| 4,091,305 | 5/1978 | Poley et al. . | |
| 4,112,329 | 9/1978 | Veith | 313/585 X |
| 4,213,072 | 7/1980 | Veith et al. . | |
| 4,323,815 | 4/1982 | Russell | 313/422 |
| 4,362,967 | 12/1982 | Littwin et al. | 313/485 X |

FOREIGN PATENT DOCUMENTS

| | | |
|---|---|---|
| 2615721 | 4/1976 | Fed. Rep. of Germany . |
| 2655498 | 12/1976 | Fed. Rep. of Germany . |
| 2750587 | 11/1977 | Fed. Rep. of Germany . |
| 2855108 | 12/1978 | Fed. Rep. of Germany . |

OTHER PUBLICATIONS

IBM Technical Disclosure Bulletin, vol. 19, No. 8, Jan. 1977.

*Primary Examiner*—Palmer C. Demeo

*Attorney, Agent, or Firm*—Herbert L. Lerner; Laurence A. Greenberg

[57] ABSTRACT

Flat viewing screen having a matrix of selectively addressable picture elements, including two mutually parallel support plates being vacuum-tightly connected to each other and having sides facing each other, at least one separately addressable electrode disposed on each of the sides, a multiplicity of spacers each being assigned to one picture element for spacing said support plates from each other, each spacer including a pin being integral with and protruding from one of the support plates and a hollow cylinder having an inner surface and a bottom and being integral with and protruding from the other of the support plates, each pin being inserted into one hollow cylinder at a space from the inner surface and contacting the bottom of the hollow cylinder, and a method of producing the same.

7 Claims, 3 Drawing Figures

FLAT VIEWING SCREEN WITH SPACERS BETWEEN SUPPORT PLATES AND METHOD OF PRODUCING SAME

The invention relates to flat a viewing screen with a matrix of selectively addressable picture elements, including two mutually parallel support plates, such as a front and back plate, which are vacuum-tightly connected to each other, the plates each carry at least one separately addressable electrode on their sides facing each other, and are spaced from each other by a multiplicity of spacers, as well as to production techniques and possible applications for this tube. A display of the kind mentioned above is described, for instance, in U.S. Pat. No. 4,091,305.

In practice, the spacing of the two carrier plates still presents considerable difficulties because it must be ensured that the two substrates accurately maintain a predetermined spacing on the entire display surface and a construction therefore must be found, by means of which the plates can withstand the high external pressure without any deformation, while the support and spacing elements must be of such a nature that they do not impair the optical qualities of the panel.

In recent years a number of experiments have been undertaken to solve the hereinafore-mentioned problems. Thus, the idea has occurred, for instance, to distribute a multiplicity of relatively small-volume spacers in the space between the two plates. However, it was found that this approach was successful only if great care was taken in positioning the individual particles and the particles were fixed in their place with considerable effort (see in this connection, the patent cited at the outset, according to which metal bodies are to be placed on conductor runs and are to be fastened by thermal pressure metallization or the like, and also see "IBM Technical Disclosure Bulletin" 19 (1977) 3006 or 20 (1978) 3496, according to which glass particles are placed in substrate depressions or put in the space provided by a distribution template and tacked-on by melting a substrate coating).

The placing and anchoring effort is no doubt reduced if large-area spacer units are resorted to, such as structures with honeycomb-like or garland or festoon-like patterns (shown in U.S. Pat. No. 4,213,072) or regularly perforated plates (shown in German Published, Non-Prosecuted Application DE-OS No. 28 55 108). This greater ease is obtained, however, at the expense of a relatively laborious production, because the spacer structures must be provided with breakthroughs which may in some circumstances form a very fine raster and should furthermore be accurately aligned with every picture element. The requirements are particularly strict if the display operates with electron beams, and short-circuits and/or display defects must accordingly be expected due to wall charges.

It is accordingly an object of the invention to provide a flat viewing screen and method of producing the same, which overcomes the hereinafore-mentioned shortcomings of the heretofore known devices and methods of this general type, and to do so with a plate-spacing system which causes no special production or assembly problems, ensures a well-defined substrate spacing, is pressure and high-voltage proof, permits even very fine picture element rasters, and in addition is also suitable for extremely flat electron beam panels.

With the foregoing and other objects in view there is provided, in accordance with the invention, a flat viewing screen having a matrix of selectively addressable picture elements, comprising two mutually parallel support plates, such as a front and back plate, being vacuum-tightly connected to each other and having sides facing each other, at least one separately addressable electrode disposed on each of the sides, a multiplicity of spacers each being assigned to one picture element for spacing the support plates from each other, each spacer including a pin being integral with and protruding from one of the support plates and a hollow cylinder having an inner surface and a bottom and being integral with and protruding from the other of the support plates, each pin being inserted into one hollow cylinder at a space from the inner surface and contacting the bottom of the hollow cylinder.

The processed display is primarily distinguished by the feature that all spacers are also positioned correctly without special measures in relation to the picture elements, are short-circuit-proof due to a long leakage path and, last but not least, can be produced in an extremely simple manner. Thus, it is sufficient to deep-etch the plates, using suitable masks or, as a particularly elegant method, to structure them by a pressing operation. In addition, the picture quality is normally not impaired appreciably; it is even maintained under unfavorable thermal conditions as well and/or after extended periods of operation, since the spacers provided according to the invention are ideally matched thermally to the support plate.

It is no longer new per se to use spacer elements with a folded surface for improving the high voltage strength; see in this connection U.S. Pat. No. 4,112,329. In that device, however, the spacer parts do not belong to the support plates; the pins are furthermore brought through openings in one support plate and end in cups put on the outside.

The picture tube according to the invention is suitable primarily for the display of television pictures and preferably operates with electrons which are generated in the rear part of the tube by means of a control matrix and are conducted to the front onto an anode coated with phosphorus. Cold cathodes or photo cathodes with an IR control matrix attached to the outside, especially appear to make sense here as an electron source, because in these cases the overall construction can be kept very simple, rugged, flat and tight. Calculations show that with a screen area of 400 mm × 600 mm an overall depth of less than 10 mm and a weight of less than 3 kg are possible without difficulty.

In accordance with another feature of the invention, the support plates are in the form of a front and a back plate, the pins being integral with the front plate and the hollow cylinders being integral with the back plate.

In accordance with a further feature of the invention, the pins and hollow cylinders have round or rectangular cross sections.

In accordance with an added feature of the invention, there is provided a resistive layer coating at least one of the pins and hollow cylinders.

In accordance with an additional mode of the invention, there is provided a method of producing a viewing screen having a matrix of selectively addressable picture elements, which comprises working out the pins and hollow cylinders from the support plates through an etching process.

In accordance with a concomitant mode of the invention, there is provided a method which comprises working out the pins and hollow cylinders from the support plates through a pressing process.

Other features which are considered as characteristic for the invention are set forth in the appended claims.

Although the invention is illustrated and described herein as embodied in a flat viewing screen and method of producing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
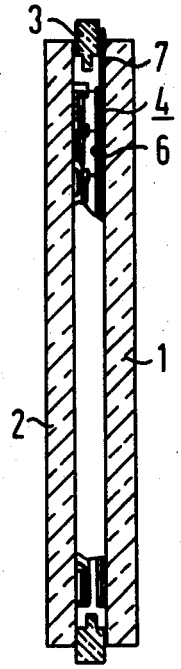
FIG. 1 is a diagrammatic cross-sectional side view of an embodiment of the invention.

Referring to the figures of the drawing and first particularly to FIG. 1 thereof, it is seen that the display shown is intended as a viewing screen of a color television set. The vacuum envelope of the set includes two parallel support or carrier plates (front plate 1 and back plate 2), which are connected to each other by a frame 3.

The front plate 1 carries on its rear side a family of anode strips 4 which are disposed parallel to each other and each of which is coated with a phosphorus stripe 6. Every third phosphorus stripe lights up in the same color upon electron bombardment. (Color pictures can be generated, as is well known, by three basic colors, which as a rule are red, green and blue). The anode strips 4 which carry phosphorus of the same color are always brought to a common terminal 7 which is passed through the vacuum envelope between the frame 3 and the front plate 1.

Figure 2:
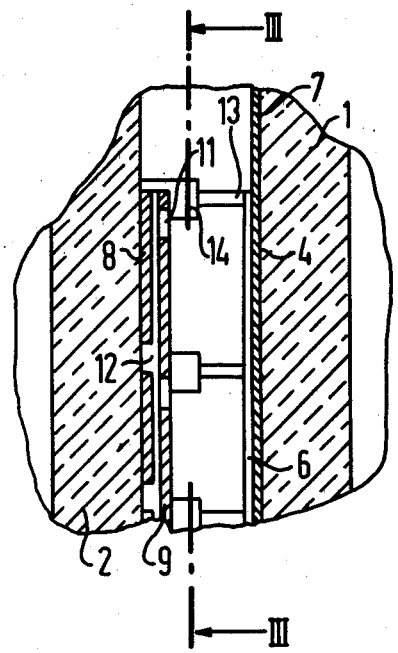
FIG. 2 is a fragmentary enlarged detailed view of FIG. 1.
Figure 3:
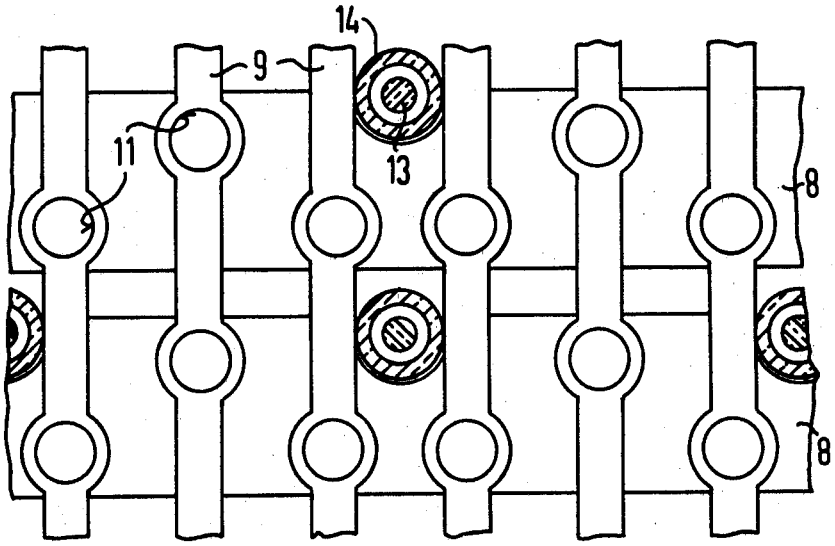
FIG. 3 is a fragmentary cross-sectional view, partially broken away, of the embodiment of FIG. 1, taken along the line III—III in FIG. 2, in the direction of the arrows, without a cathode layer.

As shown in FIGS. 2 and 3, the back plate 2 contains a control matrix of row conductors 8 and column conductors 9, the column conductors being provided with openings II at the crossings of the matrix. Between the two conductor planes, there is disposed a cathode layer which has an active cathode element at every crossing point. In the present case, the cathode elements are cold cathodes with hetero-junctions and negative electrode affinity of the GaP-GaAlP type. A more detailed presentation of this control matrix may be found in the German Patent Application with the title "Flat Picture Tube" filed on Sept. 24, 1980, now German published application No. DE-OS No. 30 35 988, published, Apr. 29, 1982.

The two carrier or support plates 1, 2 are spaced from each other by spacers, the construction of which can best be seen in FIGS. 2 and 3. The front plate 1 contains a regular pattern of pin-like projections, shown as pins 13, and the back plate 2 has a corresponding pattern of hollow cylindrical projections shown as hollow cylinders 14. Each pin 13 extends into one of the hollow cylinders 14 without touching its side wall, and makes contact with the cylinder bottom. In this manner, a relatively long path is brought about between the control matrix and the anode strips 4 along the spacer surface. The two plates 1, 2 can be brought together to a spacing of about 1 mm if the display is to be operated with a high voltage of several kV. FIG. 3 shows how the individual spacer elements are distributed in the control matrix. A spacer is associated with each picture element which is formed by the color triplet red/green/blue. In a typical example, the cathode elements have a diameter of 0.2 mm, the phosphorus stripes 6 have a width of 0.4 mm, the hollow cylinders 14 have an outside diameter of 0.4 mm and an inside diameter of 0.25 mm, and the supports 1, 2 have a cross section of barely 0.2 mm.

Occasionally, noticeable wall charges can occur at the spacer elements, if, for instance, the pins and/or hollow cylinders have relatively large transverse dimensions. In such a case, it is advisable to coat the pin or hollow cylinder surfaces facing the electron rays with a slightly conducting coating, such as lithium compound in an aqueous solution.

The display operates as follows:

The individual row conductors are scanned sequentially in time, and while one row is switched on, the columns sequentially receive the three color separations of the row information and the corresponding anode strips simultaneously receive a high-voltage signal.

In the present case, the two support plates are formed of glass substrates being a few mm thick, the frame of a glass part which is about 1 mm thick, and the electrodes formed of metals customary for this purpose, such as titanium, gold or platinum. The substrates have been given their projections by a hot-pressing process, in which a suitably formed die is pressed at elevated temperatures onto the initially as yet flat plate surface. The conductors and phosphorus layers are prepared by customary thin-film techniques.

The invention is not limited to the embodiment example shown. Considerable latitude still exists, especially in the construction of the spacers. For instance, rectangular cross-sections could also be chosen instead of round ones and the pin-receiving parts could be provided with a bottom which is not at the level of the remaining plate surface. The term "hollow cylinder" used herein is to be interpreted with corresponding breadth.

There are claimed:

1. Flat viewing screen having a matrix of selectively addressable picture elements, comprising two mutually parallel support plates of glass being vacuum-tightly connected to each other and having sides facing each other, at least one separately addressable electrode disposed on each of said sides, a multiplicity of spacers each being assigned to one picture element for spacing said support plates from each other, each spacer including a pin being integral with and protruding from one of said support plates and a hollow cylinder having an inner surface and a bottom and being integral with and protruding from the other of said support plates, each pin being inserted into one hollow cylinder at a space from said inner surface and contacting said bottom of said hollow cylinder.

2. Viewing screen according to claim 1, wherein said support plates are in the form of a front and a back plate, said pins being integral with said front plate and said hollow cylinders being integral with said back plate.

3. Viewing screen according to claim 1, wherein said pins and hollow cylinders have round cross sections.

4. Viewing screen according to claim 1, wherein said pins and hollow cylinders have rectangular cross sections.

5. Viewing screen according to claim 1, including a resistive layer coating on at least one of said pins and hollow cylinders.

6. Method of producing a viewing screen having a matrix of selectively addressable picture elements according to claim 1, including two mutually parallel support plates being vacuum-tightly connected to each other and having sides facing each other, at least one separately addressable electrode disposed on each of the sides, a multiplicity of spacers each being assigned to one picture element for spacing the support plates from each other, each spacer including a pin being integral with and protruding from one of the support plates and a hollow cylinder having an inner surface and a bottom and being integral with and protruding from the other of the support plates, each pin being inserted into one hollow cylinder at a space from the inner surface and contacting the bottom of the hollow cylinder, which comprises working out the pins and hollow cylinders from the support plates through an etching process.

7. Method of producing a viewing screen having a matrix of selectively addressable picture elements according to claim 1, including two mutually parallel support plates being vacuum-tightly connected to each other and having sides facing each other, at least one separately addressable electrode disposed on each of the sides, a multiplicity of spacers each being assigned to one picture element for spacing the support plates from each other, each spacer including a pin being integral with and protruding from one of the support plates and a hollow cylinder having an inner surface and a bottom and being integral with and protruding from the other of the support plates, each pin being inserted into one hollow cylinder at a space from the inner surface and contacting the bottom of the hollow cylinder, which comprises working out the pins and hollow cylinders from the support plates through a pressing process.

* * * * *